US010358893B2

(12) United States Patent
Greci

(10) Patent No.: US 10,358,893 B2
(45) Date of Patent: Jul. 23, 2019

(54) WELLBORE SYSTEMS CONFIGURED FOR INSERTION OF FLOW CONTROL DEVICES AND METHODS FOR USE THEREOF

(71) Applicant: Halliburton Energy Services, Inc., Houston, TX (US)

(72) Inventor: Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 601 days.

(21) Appl. No.: 14/394,506

(22) PCT Filed: Oct. 31, 2013

(86) PCT No.: PCT/US2013/067664
§ 371 (c)(1),
(2) Date: Oct. 15, 2014

(87) PCT Pub. No.: WO2015/065404
PCT Pub. Date: May 7, 2015

(65) Prior Publication Data

US 2015/0376983 A1 Dec. 31, 2015

(51) Int. Cl.
*E21B 34/14* (2006.01)
*E21B 34/12* (2006.01)
(Continued)

(52) U.S. Cl.
CPC ..... *E21B 34/12* (2013.01); *E21B 34/14* (2013.01); *E21B 43/08* (2013.01); *E21B 43/10* (2013.01);
(Continued)

(58) Field of Classification Search
CPC ..... E21B 34/12; E21B 34/14; E21B 43/08; E21B 43/10; E21B 43/12; E21B 2034/007
See application file for complete search history.

(56) References Cited

U.S. PATENT DOCUMENTS

2006/0118296 A1 6/2006 Dybevik et al.
2006/0131033 A1 6/2006 Bode et al.
(Continued)

FOREIGN PATENT DOCUMENTS

WO 2015065404 A1 5/2015

OTHER PUBLICATIONS

International Search Report and Written Opinion for PCT/US2013/067664 dated Jul. 24, 2014.

*Primary Examiner* — Brad Harcourt
*Assistant Examiner* — David Carroll
(74) *Attorney, Agent, or Firm* — McGuireWoods LLP

(57) ABSTRACT

It is sometimes desirable to regulate fluid flow using autonomous inflow control devices (AICDs), but they are not readily configurable in the field. Wellbore systems providing adjustable flow control may comprise: a wellbore pipe having an interior space, an outer surface, and one or more orifices defined in the wellbore pipe and extending between the interior space and the outer surface; a flow control assembly fixedly coupled to the wellbore pipe and comprising one or more flow chambers defined on the outer surface of the wellbore pipe that are in fluid communication with the one or more orifices; a movable cover configured to provide access to the one or more flow chambers; and a bung arranged within at least one of the one or more orifices, the bung being configured to accept an insert therein, the insert being at least one of an AICD, a blank, or any combination thereof.

18 Claims, 2 Drawing Sheets

(51) Int. Cl.

| | |
|---|---|
| ***E21B 43/10*** | (2006.01) |
| ***E21B 43/12*** | (2006.01) |
| ***E21B 43/08*** | (2006.01) |
| *E21B 34/00* | (2006.01) |

(52) U.S. Cl.
CPC ..... *E21B 43/12* (2013.01); *E21B 2034/007* (2013.01)

(56) References Cited

U.S. PATENT DOCUMENTS

| | | | | |
|---|---|---|---|---|
| 2008/0169099 | A1* | 7/2008 | Pensgaard | E21B 33/138 166/285 |
| 2009/0000787 | A1 | 1/2009 | Hill et al. | |
| 2011/0024105 | A1* | 2/2011 | Hammer | E21B 34/14 166/113 |
| 2011/0073308 | A1 | 3/2011 | Assal et al. | |
| 2013/0075112 | A1* | 5/2013 | Franklin et al. | E21B 34/066 |
| 2013/0180724 | A1 | 7/2013 | Nguyen | |
| 2013/0319664 | A1* | 12/2013 | McNamee | E21B 34/08 166/276 |
| 2014/0000869 | A1* | 1/2014 | Holderman | E21B 33/127 166/187 |
| 2014/0007954 | A1* | 1/2014 | Veit | E21B 21/103 137/528 |
| 2016/0230509 | A1* | 8/2016 | Lopez | E21B 43/08 |

* cited by examiner

WELLBORE SYSTEMS CONFIGURED FOR INSERTION OF FLOW CONTROL DEVICES AND METHODS FOR USE THEREOF

BACKGROUND

The present disclosure generally relates to the regulation of fluid flow in a subterranean formation, and, more specifically, to wellbore systems that are configured for on-site flow adjustment and methods for their deployment during operations in a subterranean formation.

It can often be beneficial to regulate the flow of formation fluids within a wellbore penetrating a subterranean formation. A variety of conditions and/or intended purposes can necessitate such flow regulation including, for example, preventing water and/or gas coning, minimizing water and/or gas production, minimizing sand production, maximizing oil production, balancing production from various subterranean zones, equalizing pressure among various subterranean zones, and/or the like.

Likewise, regulation of the flow of injection fluids such as, for example, water, steam or gas, within a wellbore can also sometimes be desirable. Flow regulation of an injection fluid can be particularly useful, for example, to control the distribution of the injection fluid within various subterranean zones and/or to prevent the introduction of the injection fluid into currently producing zones.

A number of different types of flow resistance devices have been developed in order to meet the foregoing needs. Many flow resistance devices can variably occlude the passage of some fluids more than others based upon one or more physical property differences between the fluids. Illustrative physical properties of a fluid that can determine its rate of passage through a variable flow resistance device can include, for example, viscosity and density. Variable flow resistance devices can promote the passage of enhanced ratios of a desired fluid to an undesired fluid through a flow pathway containing the variable flow resistance device compared to that obtained when the variable flow resistance device is not present. Many variable flow resistance devices function autonomously as a consequence of their design and will be referred to herein as autonomous inflow control devices (AICDs), a number of which will be familiar to one having ordinary skill in the art. Many AICDs function by inducing rotational motion in a fluid, such that lower viscosity fluids experience a longer transit time therethrough than do more viscous fluids, such as oil or a like hydrocarbon resource. The preferential passage of oil or a like hydrocarbon resource through an AICD can allow enhanced production from a subterranean formation to be realized. However, AICDs may be used in other subterranean operations as well, such as injection operations, for example.

Although AICDs can be used with considerable success during subterranean operations, there are some issues associated with their use that are not readily addressed at present. Most often, a set number of AICDs are housed in a flow control assembly that is coupled to the outer surface of a wellbore pipe, which may also be referred to herein as production tubing or completion tubing. Accordingly, flow regulation using AICDs is presently an all or nothing venture for a well operator, at least without considerable and costly manufacturing alterations to produce custom flow control assemblies with a desired number of AICDs.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1:
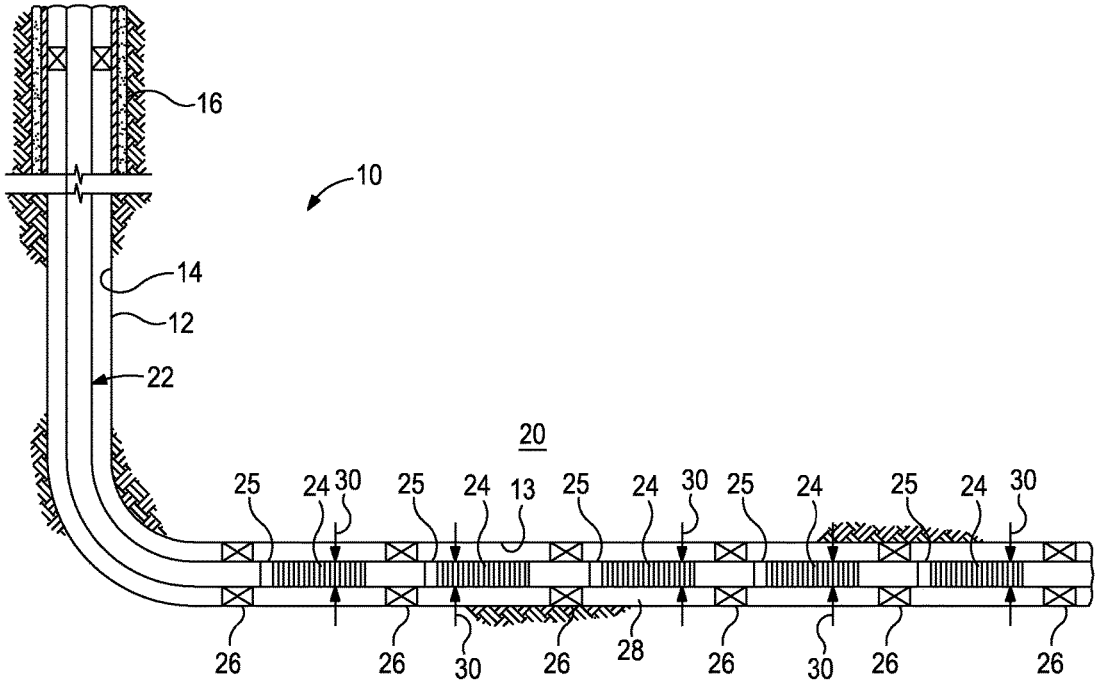
FIG. 1 shows an illustrative schematic of a wellbore system including a plurality of flow control assemblies coupled to a wellbore pipe.

The present disclosure generally relates to the regulation of fluid flow in a subterranean formation, and, more specifically, to wellbore systems that are configured for on-site flow adjustment and methods for their deployment during operations in a subterranean formation.

One or more illustrative embodiments incorporating the disclosure herein are presented below. Not all features of a physical implementation are described or shown in this application for the sake of clarity. It is to be understood that in the development of a physical embodiment incorporating the embodiments of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for one having ordinary skill the art and the benefit of this disclosure.

While systems and methods are described herein in terms of "comprising" various components or steps, the systems and methods can also "consist essentially of" or "consist of" the various components and steps. Unless otherwise indicated, all numerical quantities expressed herein are to be understood as being modified in all instances by the term "about." Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Although AICDs and other flow resistance devices can be used with considerable success in various subterranean operations, particularly during production or injection operations, off-the-shelf flow control assemblies containing a fixed number AICDs can sometimes be insufficient or sub-optimal for performing a particular job. For example, once a well has been drilled and logged, it may be the case that the AICD configuration originally planned for use in the wellbore is, in fact, rather unsuitable for the conditions that are actually present. At the very least, even if a flow control assembly with a suitable AICD configuration exists, delays in shipping it to a job site can represent a significant time and expense issue. Manufacturing a flow control assembly with a customized AICD configuration suited for performing a particular job represents an even greater time and expense concern.

Flow control assemblies are typically made with a few set configurations of AICDs and are stockpiled by a manufacturer. The flow control assemblies are then coupled to a wellbore pipe at a job site. The embodiments of the present disclosure alter this paradigm by allowing a desired number and type of AICDs to be inserted into or removed from a wellbore system, usually at a job site, in order to produce a customized degree of flow regulation. The embodiments described herein particularly illustrate how AICDs, blank devices (simply referred to hereinafter as "blanks"), or any combination thereof may be accessed and manipulated to provide a customized degree of flow regulation in a wellbore system. More specifically, the embodiments described herein illustrate how AICDs, blanks, or any combination thereof may be removably coupled to a wellbore pipe in order to produce a customized degree of fluid flow regulation, and how these components may be readily accessed and interchanged by making simple manufacturing alterations to a flow control assembly. Thus, the embodiments of the present disclosure beneficially allow manufacturers to continue to stockpile a limited number of modifiable device configurations, which can then be altered in the field, if needed, by an operator to provide a desired degree of fluid flow regulation.

Moreover, as a consequence of the way in which the AICDs are coupled to a wellbore pipe in the present disclosure, an injected fluid is exposed to a minimal piston area of the AICDs. The small exposed piston area of the AICDs allows a minimal differential pressure drop to occur across the AICDs during injection operations as a fluid passes therethrough. By minimizing the piston area, the construction of a housing for the AICDs can be less robust while still maintaining an equivalent injection differential pressure rating. Further, AICDs of various design configurations can be chosen to provide a desired piston area and degree of fluid flow regulation.

Before discussing further how the above features may be realized, a brief discussion of wellbore systems capable of producing flow control in a subterranean formation will be provided. FIG. 1 shows an illustrative schematic of wellbore system 10 including a plurality of flow control assemblies 25 coupled to wellbore pipe 22. As depicted in FIG. 1, wellbore 12 has generally vertical uncased section 14 extending downwardly from casing 16, as well as generally horizontal uncased section 13 extending through subterranean formation 20. Wellbore pipe 22 (e.g., production tubing or completion tubing) is installed in wellbore 12. Interconnected to wellbore pipe 22 and making a fluid connection therewith are multiple well screens 24 and flow control assemblies 25, the latter potentially containing one or more AICDs. Packers 26 seal off annulus 28 formed radially between wellbore pipe 22 and uncased section 13. In this manner, fluids 30 may be produced from multiple intervals or zones of subterranean formation 20 via isolated portions of annulus 28 between adjacent packers 26.

Positioned between adjacent packers 26 are well screen 24 and flow control assembly 25, which form a fluid connection to the interior of wellbore pipe 22. Well screen 24 filters fluids 30 flowing from annulus 28 into the interior of wellbore pipe 22, thereby protecting the components of flow control assembly 25, which lies downstream of well screen 24. Flow control assembly 25 variably restricts the flow of fluids 30 into the interior of wellbore pipe 22, which may be based on certain physical properties of the fluids and their interaction with one or more AICDs housed therein. Suitable well screens 24 will be familiar to one having ordinary skill in the art and may include, but are not limited to, swell screens, wraps, meshes, sintered screens, and the like.

It should be noted that wellbore system 10 represents merely one example of a wide variety of wellbore systems in which the various aspects of this disclosure can be implemented. It should be clearly understood that the principles of this disclosure are not limited to the details of wellbore system 10 or its depicted components. For example, it is not necessary that wellbore 12 include generally vertical uncased wellbore section 14 or generally horizontal uncased wellbore section 13. It is also not necessary for well screens 24, flow control assemblies 25, packers 26 or any other components to be positioned in a cased or uncased section of wellbore 12. Any section of wellbore 12 may be cased or uncased, and any portion of wellbore pipe 22 or any component extending therefrom may be positioned in an uncased or cased section of wellbore 12 in keeping with the principles of this disclosure.

Zonal isolation with packers 26 is also not required. However, it will be appreciated by one having ordinary skill in the art that it can be beneficial to regulate the flow of fluids 30 into the interior of wellbore pipe 22 from each zone of subterranean formation 20 to prevent water coning or gas coning, for example. Other instances in which zonal flow regulation can be desirable include, but are not limited to, balancing production from (or injection into) multiple zones, minimizing or maximizing production or injection of undesired fluids, and the like. Hence, it is also not necessary for fluids 30 to only be produced from subterranean formation 20 since, in other examples, fluids can be injected into subterranean formation 20 and subsequently be produced therefrom.

It is further not necessary for a single flow control assembly 25 to be used in conjunction with a single well screen 24. Any number, arrangement and/or combination of these components may be used. Moreover, in some embodiments, well screen 24 may be omitted, if desired. For example, in injection operations, an injected fluid may be flowed through flow control assembly 25 without also flowing through a well screen.

The embodiments of the present disclosure allowing for adjustment of fluid flow to take place by accessing and configuring one or more AICDs will now be described in greater detail. More specifically, the description hereinafter will demonstrate how a desired number of AICDs may be removably coupled to a wellbore pipe for producing a desired degree of fluid flow into the interior space of the wellbore pipe.

Figure 2:
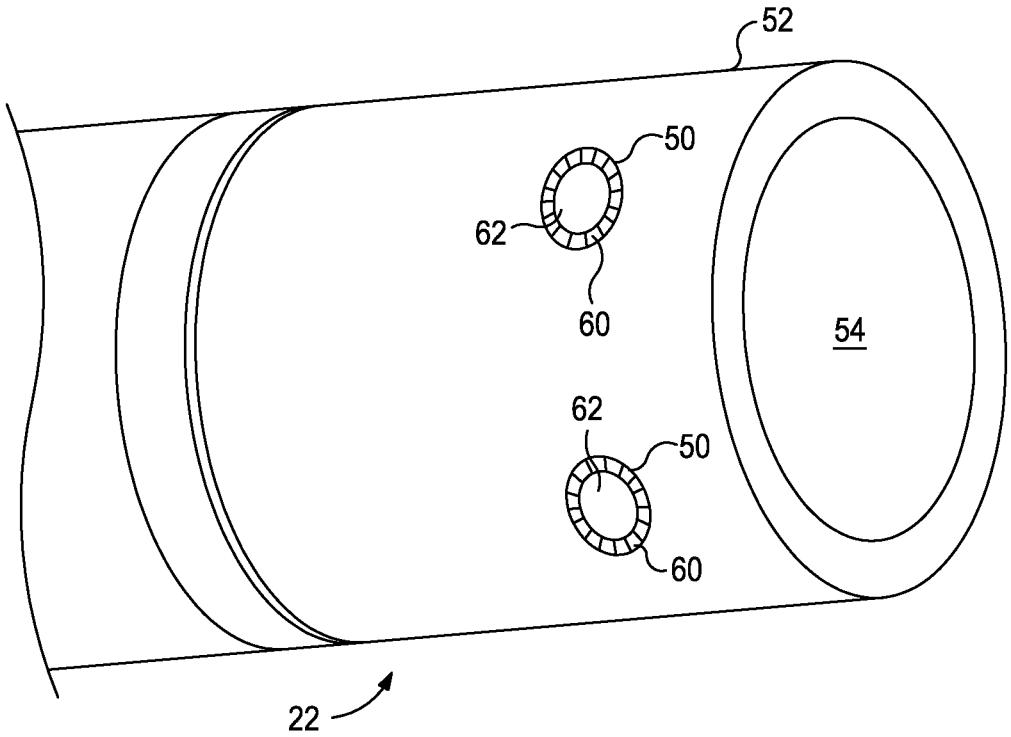
FIG. 2 shows a section of a wellbore pipe having one or more orifices extending between its outer surface and interior space with a bung inserted therein.

With continued reference to FIG. 1, FIG. 2 shows a section of wellbore pipe 22 having one or more orifices 50 extending between outer surface 52 and interior space 54 of wellbore pipe 22. Orifices 50 each contain bung 60, which is arranged therein and fixedly coupled thereto. Bung 60 further includes opening 62 in which various inserts may be placed, as further described below in reference to FIG. 3. Bung 60 may removably accept an insert in opening 62 by being configured to form an O-ring seal about the insert, thereby forming a fluid seal between bung 60 and the insert. Other techniques for forming a fluid seal between bung 60 and the insert may also be suitable, as discussed below. Inserts which may be positioned in opening 62 of bung 60 may include, for example, AICDs, blanks, or any combination thereof. Before further discussing these components and the coupling of a flow control assembly to wellbore pipe 22, bung 60 and its coupling to wellbore pipe 22 will be further described.

In general, a variety of materials may be used to construct bung 60. Illustrative materials that may be used for construction of bung 60 include, for example, metals, carbide compounds (particularly metal carbides), ceramics, plastics, and the like. In some embodiments, bung 60 may comprise the same material as wellbore pipe 22, and in other embodiments they may differ. In some embodiments, bung 60 may be formed from a carbide compound, particularly a metal carbide. Other carbide compounds, such as silicon carbide, may also be suitable. In more particular embodiments, bung 60 may include a coating of a carbide compound over another material, such as a metal.

The technique through which bung 60 becomes fixedly coupled to wellbore pipe 22 is not limited to the present disclosure. Illustrative coupling techniques that may be suitable include welding, brazing, soldering, and the like. In addition, bung 60 may be held in place in orifice 50 by screw threads, which may be used in combination with the previously discussed coupling techniques.

Figure 3:
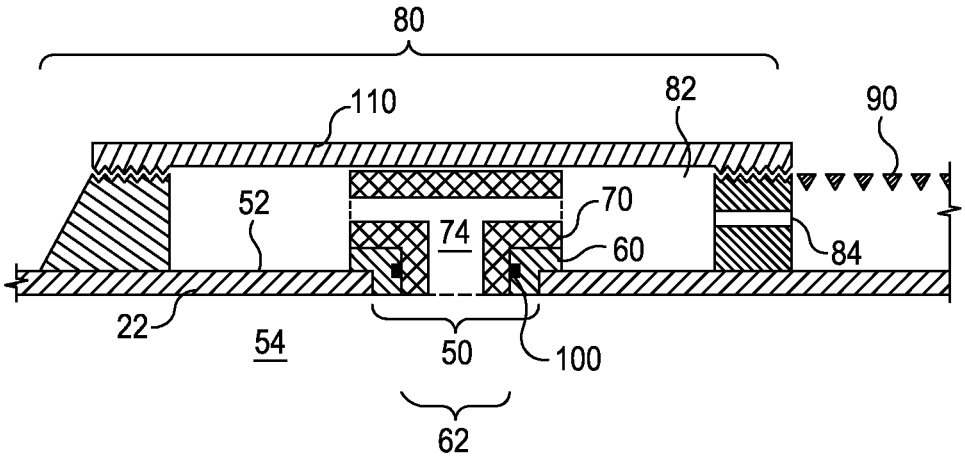
FIG. 3 shows an expanded side view schematic of an orifice on a wellbore pipe containing a bung and an AICD inserted into the bung's opening.

With continued reference to FIGS. 1 and 2, FIG. 3 shows an expanded side view schematic of orifice 50 defined on or in wellbore pipe 22 containing bung 60 and AICD 70 inserted into opening 62 of bung 60. Flow control assembly 80 is fixedly coupled to wellbore pipe 22 to define flow chamber 82 on outer surface 52. Flow chamber 82 is fluidly coupled to fluid inlet 84 and orifice 50. Well screen 90 may optionally be coupled to wellbore pipe 22, thereby establishing fluid communication to fluid inlet 84. AICD 70 contains one or more flow paths 74 therethrough, thereby allowing a fluid to pass from fluid inlet 84 into flow chamber 82 and ultimately be discharged into interior space 54.

As depicted in FIG. 3, AICD 70 includes an O-ring 100 to provide a fluid seal between AICD 70 and bung 60. Other techniques for achieving such a fluid seal may include, for example, welding, soldering, gluing, pipe threading, compression fitting, and the like. Use of an O-ring for forming a fluid seal between AICD 70 and bung 60 may allow AICD 70 to be removably coupled to wellbore pipe 22. Suitable materials for an O-ring will be familiar to one having ordinary skill in the art, and may be dictated at least to some extent by the nature of a fluid to which the O-ring is being exposed.

In some embodiments, AICD 70 can differentially restrict a fluid passing therethrough by inducing rotational motion in one or more components of the fluid. The design and function of AICDs, particularly those capable of inducing rotational motion, will be familiar to one having ordinary skill in the art, and these components will not be described herein in any significant detail. Even though AICDs may be quite complex in structure, the simplified renditions of the FIGURES will be sufficient for one having ordinary skill in the art to gain an understanding of the embodiments described herein.

With continued reference to FIG. 3, access to flow chamber 82 may be achieved through movable cover 110. In conventional configurations in which AICDs are used, in contrast, access to flow chamber 82 around AICD 70 is generally not permitted since flow chamber 82 is typically enclosed by a cover that is permanently affixed in place. In the configuration depicted in FIG. 3, movable cover 110 is in the form of a sliding sleeve, which may be threaded onto flow control assembly 80. However, other means for accessing flow chamber 82 may also be utilized. Alternative structures for accessing flow chamber 82 may include, for example, a swinging panel, an access port, a mechanically fastened plate (e.g., using one or more mechanical fasteners, such as bolts, screws, pins, snap rings, etc.), and the like. Movable cover 110 forms a fluid seal with flow chamber 82 so that a fluid may flow therethrough to AICD 70. In addition to fluidly sealing flow chamber 82, movable cover 110 may also radially abut AICD 70 and further hold it in place within bung 60, although it is not a requirement that these components radially abut one another. For example, in some embodiments, movable cover 110 may nearly radially abut AICD 70 such that its potential range of motion is limited. Nevertheless, having movable cover 110 and AICD 70 radially abutting one another may allow greater fluid pressures to be exerted upon AICD 70 during injection operations, where there may be a greater risk of accidental ejection of the AICD 70 occurring.

Any number of AICDs 70 may be inserted into openings 62 in order to achieve a desired degree of flow control. Any openings 62 not filled with AICDs 70 may instead be filled with a blank or plug (not depicted) containing no flow pathway therethrough, so as to effectively shut off fluid flow through that particular flow chamber 82. In general, any solid body not having a flow pathway defined therethrough and that may be inserted within opening 62 may serve as a blank in the embodiments described herein. Blanks may be held in place in openings 62 in the same manner as AICDs 70, and they may also radially abut or nearly radially abut movable cover 110.

In general, any combination of AICDs 70 and/or blanks may be inserted into openings 62 before flow control assembly 80 is inserted into a wellbore penetrating a subterranean formation, thereby allowing an operator to configure a wellbore system to produce a desired degree of flow regulation. That is, modifications within flow chambers 82 may take place on or near the earth's surface once a well operator determines the extent to which the rate of fluid flow needs to be altered.

Moreover, if limited or no fluid flow regulation is desired, both AICDs 70 and blanks may be omitted, thereby leaving at least some of openings 62 unfilled. As a further element of refinement, it is not necessary that the same type of AICDs 70 be inserted in all openings 62. Thus, the systems and methods described herein can provide considerable flexibility to an operator at a job site.

In various embodiments, wellbore systems that are configurable to alter the rate of passage of a fluid therethrough are described herein. In some embodiments, the wellbore systems may comprise: a wellbore pipe having an interior space, an outer surface, and one or more orifices defined in the wellbore pipe and extending between the interior space and the outer surface; a flow control assembly fixedly coupled to the wellbore pipe and comprising one or more flow chambers defined on the outer surface of the wellbore pipe that are in fluid communication with the one or more orifices; a movable cover configured to provide access to the one or more flow chambers; and a bung arranged within at least one of the one or more orifices, the bung being configured to accept an insert therein, the insert being at least one of an autonomous inflow control device (AICD), a blank, or any combination thereof.

In some embodiments, the wellbore systems may further comprise an insert positioned within each bung. The insert may comprise an AICD, a blank, or any combination thereof. In some embodiments, an O-ring may form a fluid seal between the bung and the insert.

In some embodiments, the wellbore systems may comprise: a wellbore pipe having an interior space, an outer surface, and one or more orifices defined in the wellbore pipe and extending between the interior space and the outer surface; a flow control assembly fixedly coupled to the wellbore pipe and comprising one or more flow chambers defined on the outer surface of the wellbore pipe that are in fluid communication with the one or more orifices; a movable cover configured to provide access to the one or more flow chambers; a bung arranged within at least one of the one or more orifices; and an insert removably positioned within each bung.

In some embodiments, the wellbore systems may further comprise a well screen that is fluidly coupled to an inlet of the flow control assembly.

In various embodiments, the movable cover may form a fluid seal with the one or more flow chambers defined on the outer surface of the wellbore pipe. In some embodiments, the movable cover may comprise a sliding sleeve. Alternative structures for accessing the flow chambers and forming a fluid seal therewith may include, for example, a swinging panel, an access port, a threaded plate, and the like.

In some embodiments, the movable cover and the insert may radially abut one another, thereby further holding the insert in place within the bung. In other embodiments, the movable cover and the insert do not come into contact with one another, but they may nearly radially abut one another, so as to limit the potential range of motion of the insert.

The manner in which the bung and the wellbore pipe are connected to one another is not believed to be particularly limited. In some embodiments, the bung may be welded to the wellbore pipe. In other embodiments, the bung may be threaded to the wellbore pipe. In still other embodiments, the bung may be both threaded and welded to the wellbore pipe.

As mentioned above, the exemplary wellbore systems disclosed herein may be used in conjunction with various operations conducted within a wellbore penetrating a subterranean formation. In some embodiments, the wellbore systems described herein may be used in conjunction with producing a fluid from a subterranean formation via the wellbore pipe. In other embodiments, the wellbore systems described herein may be used in conjunction with injecting a fluid into a wellbore via the wellbore pipe. In either case, the exemplary wellbore systems described herein may be readily configured on-site to alter their fluid flow characteristics to a desired degree. In this regard, the wellbore systems offer increased efficiency and decreased costs compared to custom manufacturing a flow control assembly with a desired number and configuration of AICDs. Moreover, by having the opportunity to modify flow characteristics in the field, an operator may be able to more proactively respond to unexpected conditions that may be encountered after drilling and logging a formation.

Any of the exemplary wellbore systems described herein or any combination thereof may be used in conjunction with producing a fluid from a wellbore penetrating a subterranean formation. In some embodiments, wellbore systems having a plurality of flow control assemblies disposed in series with one another and in fluid communication with a wellbore pipe may be used to separately produce a fluid from one or more intervals of a formation.

Likewise, any of the exemplary wellbore systems described herein or any combination thereof may be used in conjunction with injecting a fluid into a wellbore by the wellbore pipe. In some embodiments, wellbore systems having a plurality of flow control assemblies disposed in series with one another and in fluid communication with a wellbore pipe may be used to separately inject a fluid into one or more intervals of a formation.

Methods for configuring the flow characteristics of the flow control assemblies will now be described in greater detail.

In some embodiments, methods described herein may comprise: obtaining a wellbore pipe having an interior space, an outer surface, and one or more orifices extending between the interior space and the outer surface; accessing one or more flow chambers of a flow control assembly affixed to the wellbore pipe, the one or more flow chambers being defined on the outer surface of the wellbore pipe about the one or more orifices; affixing a bung within at least one of the one or more orifices; inserting an AICD, a blank, or any combination thereof within the bung; and placing the wellbore pipe in a wellbore penetrating a subterranean formation.

In some embodiments, methods described herein may comprise: obtaining a wellbore pipe having an interior space, an outer surface, and one or more orifices extending between the interior space and the outer surface, one or more of the one or more orifices containing a bung; accessing one or more flow chambers of a flow control assembly affixed to the wellbore pipe, the one or more flow chambers being defined on the outer surface of the wellbore pipe about the one or more orifices; inserting an AICD, a blank, or any combination thereof within one or more of the bungs; and placing the wellbore pipe in a wellbore penetrating a subterranean formation. In some embodiments, the methods may further comprise affixing a bung with one or more of the one or more orifices.

In various embodiments, accessing the one or more flow chambers may comprise opening a movable cover located over at least a portion of the one or more flow chambers. Thus, once an AICD or blank has been placed within the opening of a specified bung, the movable cover may be closed to form a fluid seal over the flow chamber. In some embodiments, the movable cover may radially abut or nearly radially abut the AICD or blank so that it is held in place within the bung or that their available range of motion is limited.

In some embodiments, the wellbore pipe may be obtained with the orifices already in place therein, and the bungs may be inserted by an operator at a job site. Allowing an operator to insert bungs of a desired size may convey additional operational flexibility by permitting AICDs of different sizes, configurations, and flow capacities to be inserted into the orifices. For example, bungs may be chosen to insert AICDs with small piston areas for injection operations. In other embodiments, the wellbore pipe may be obtained with the orifices and bungs already in place, and inserts may be added or removed as necessary to configure a desired rate of fluid flow. In either case, existing manufacturing techniques may be readily altered in order to produce and configure the wellbore systems described herein.

Embodiments disclosed herein include:

A. Wellbore systems configured for adjustably regulating fluid flow. The wellbore systems comprise: a wellbore pipe having an interior space, an outer surface, and one or more orifices defined in the wellbore pipe and extending between the interior space and the outer surface; a flow control assembly fixedly coupled to the wellbore pipe and comprising one or more flow chambers defined on the outer surface of the wellbore pipe that are in fluid communication with the one or more orifices; a movable cover configured to provide access to the one or more flow chambers; and a bung arranged within at least one of the one or more orifices, the bung being configured to accept an insert therein, the insert being at least one of an autonomous inflow control device (AICD), a blank, or any combination thereof.

B. Wellbore systems configured for adjustably regulating fluid flow. The wellbore systems comprise: a wellbore pipe having an interior space, an outer surface, and one or more orifices defined in the wellbore pipe and extending between the interior space and the outer surface; a flow control assembly fixedly coupled to the wellbore pipe and comprising one or more flow chambers defined on the outer surface of the wellbore pipe that are in fluid communication with the one or more orifices; a movable cover configured to provide access to the one or more flow chambers; a bung arranged within at least one of the one or more orifices; and an insert removably positioned within each bung.

C. Methods for regulating fluid flow in a wellbore. The methods comprise: obtaining a wellbore pipe having an interior space, an outer surface, and one or more orifices extending between the interior space and the outer surface; accessing one or more flow chambers of a flow control assembly affixed to the wellbore pipe, the one or more flow chambers being defined on the outer surface of the wellbore pipe about the one or more orifices; affixing a bung within at least one of the one or more orifices; inserting an AICD, a blank, or any combination thereof within the bung; and placing the wellbore pipe in a wellbore penetrating a subterranean formation.

D. Methods for regulating fluid flow in a wellbore. The methods comprise: obtaining a wellbore pipe having an interior space, an outer surface, and one or more orifices extending between the interior space and the outer surface, one or more of the one or more orifices containing a bung; accessing one or more flow chambers of a flow control assembly affixed to the wellbore pipe, the one or more flow chambers being defined on the outer surface of the wellbore pipe about the one or more orifices; inserting an AICD, a blank, or any combination thereof within one or more of the bungs; and placing the wellbore pipe in a wellbore penetrating a subterranean formation.

Each of embodiments A, B, C and D may have one or more of the following additional elements in any combination:

Element 1: wherein the movable cover comprises a sliding sleeve.

Element 2: wherein an O-ring forms a fluid seal between the bung and an insert.

Element 3: wherein the wellbore system further comprises a well screen that is fluidly coupled to an inlet of the flow control assembly.

Element 4: wherein the wellbore system further comprises an insert positioned within each bung.

Element 5: wherein the movable cover and the insert radially abut one another.

Element 6: wherein the bung is formed from a carbide compound.

Element 7: wherein the bung is welded to the wellbore pipe, threaded to the wellbore pipe, or any combination thereof.

Element 8: wherein the insert comprises an AICD, a blank, or any combination thereof.

Element 9: wherein the method further comprises producing a fluid from the subterranean formation via the wellbore pipe.

Element 10: wherein the method further comprises injecting a fluid into the wellbore via the wellbore pipe.

Element 11: wherein accessing the one or more flow chambers comprises opening a movable cover located over at least a portion of the one or more flow chambers.

Element 12: wherein the movable cover radially abuts the AICD or the blank so as to hold it in place within a bung.

Element 13: wherein the method further comprises affixing a bung within one or more of the one or more orifices.

By way of non-limiting example, exemplary combinations applicable to A, B, C and D include:

Combination 1: The wellbore system of A or B in combination with elements 1 and 3.

Combination 2: The wellbore system of A or B in combination with elements 1 and 4.

Combination 3: The wellbore system of A or B in combination with elements 3, 4 and 5.

Combination 4: The wellbore system of A or B in combination with elements 2 and 7.

Combination 5: The method of C or D in combination with elements 1 and 9, or elements 1 and 10.

Combination 6: The method of C or D in combination with elements 1 and 11.

Combination 7: The method of C or D in combination with elements 10 and 12.

Combination 8: The method of C or D in combination with elements 10, 11 and 12.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is the following:

1. A wellbore system comprising:

a wellbore pipe having an interior space, an outer surface, and one or more orifices defined in the wellbore pipe and extending between the interior space and the outer surface;

a flow control assembly fixedly coupled to the wellbore pipe and comprising one or more flow chambers defined on the outer surface of the wellbore pipe that are in fluid communication with the one or more orifices;

a movable cover configured to provide access to the one or more flow chambers; and a plurality of bungs arranged within at least one of the one or more orifices;

a plurality of inserts removably coupled to the plurality of bungs, wherein the plurality of inserts comprises a plurality of preconfigured autonomous inflow control devices (AICDs), wherein the plurality of AICDs are configured to induce different rotational motions in one or more components of a fluid passing through the respective AICD to differentially restrict the fluid, and each preconfigured AICD of the plurality of preconfigured AICDs is positioned between the bung and the movable cover.

2. The wellbore system of claim 1, wherein the movable cover comprises a sliding sleeve.

3. The wellbore system of claim 1, further comprising:

a well screen that is fluidly coupled to an inlet of the flow control assembly.

4. The wellbore system of claim 1, wherein the movable cover and the insert radially abut one another.

5. The wellbore system of claim 4, further comprising an o-ring that forms a fluid seal between a bung of the plurality of bungs and an insert of the plurality of inserts.

6. The wellbore system of claim 1, wherein the plurality of bungs are formed from a carbide compound.

7. The wellbore system of claim 1, wherein the plurality of bungs are welded to the wellbore pipe, threaded to the wellbore pipe, or any combination thereof.

8. A method comprising:

obtaining a wellbore pipe having an interior space, an outer surface, and one or more orifices extending between the interior space and the outer surface;

accessing one or more flow chambers of a flow control assembly affixed to the wellbore pipe, the one or more flow chambers being defined on the outer surface of the wellbore pipe about the one or more orifices;

affixing a plurality of bungs within at least one of the one or more orifices;

inserting a plurality of preconfigured autonomous inflow control devices within the plurality of bungs, wherein each preconfigured AICD of the plurality of preconfigured AICDs is removable and interchangeable with another preconfigured AICD of the plurality of preconfigured AICDs, wherein the plurality of preconfigured AICDs are configured to induce different rotational motion in one or more components of a fluid passing through the respective AICD to differentially restrict the fluid, and the plurality of preconfigured AICDs are positioned between the plurality of bungs and a movable cover; and placing the wellbore pipe in a wellbore penetrating a subterranean formation.

9. The method of claim 8, further comprising:

producing a fluid from the subterranean formation via the wellbore pipe.

10. The method of claim 8, further comprising:

injecting a fluid into the wellbore via the wellbore pipe.

11. The method of claim 8, wherein accessing the one or more flow chambers comprises opening the movable cover located over at least a portion of the one or more flow chambers.

12. The method of claim 11, wherein the movable cover radially abuts the plurality of AICDs so as to hold the plurality of AICDs in place within a bung.

13. A method comprising:

obtaining a wellbore pipe having an interior space, an outer surface, and one or more orifices extending between the interior space and the outer surface, the one or more orifices containing a plurality of bungs;

accessing one or more flow chambers of a flow control assembly affixed to the wellbore pipe, the one or more flow chambers being defined on the outer surface of the wellbore pipe about the one or more orifices;

inserting a plurality of preconfigured autonomous inflow control devices within the plurality of bungs, wherein each preconfigured AICD of the plurality of preconfigured AICDs is removable and interchangeable with another preconfigured AICD of the plurality of preconfigured AICDs, wherein the plurality of preconfigured AICDs are configured to induce different rotational motion in one or more components of a fluid passing through the respective AICD to differentially restrict the fluid, and the plurality of preconfigured AICDs are positioned between the plurality of bungs and a movable cover; and placing the wellbore pipe in a wellbore penetrating a subterranean formation.

14. The method of claim 13, further comprising:

affixing a bung of the plurality of bungs within one or more of the one or more orifices.

15. The method of claim 13, wherein accessing the one or more flow chambers comprises opening the movable cover located over at least a portion of the one or more flow chambers.

16. The method of claim 15, wherein the movable cover radially abuts the plurality of AICDs so as to hold the plurality of AICDs in place within the bung.

17. The method of claim 13, further comprising:

producing a fluid from the subterranean formation via the wellbore pipe.

18. The method of claim 13, further comprising:

injecting a fluid into the wellbore via the wellbore pipe.

* * * * *